United States Patent [19]

Fletcher et al.

[11] 3,978,490

[45] Aug. 31, 1976

[54] FURLABLE ANTENNA

[76] Inventors: James C. Fletcher, Administrator of the National Aeronautics and Space Administration, with respect to an invention of; Morris A. Barnett, South Pasadena, Calif.

[22] Filed: Sept. 24, 1975

[21] Appl. No.: 616,333

[52] U.S. Cl. ..... 343/882; 343/915

[51] Int. Cl.[2] ..... H01Q 15/20

[58] Field of Search ..... 343/840, 881, 882, 915

[56] References Cited

UNITED STATES PATENTS

| | | | |
|---|---|---|---|
| 3,671,965 | 6/1972 | Rabenhorst et al. | 343/915 |
| 3,680,144 | 5/1972 | Ludwig | 343/840 |

*Primary Examiner*—Eli Lieberman

*Attorney, Agent, or Firm*—Monte F. Mott; Wilfred Grifka; John R. Manning

[57] ABSTRACT

An improved furlable antenna particularly suited for use in a celestial space environment. The antenna is characterized by an actuator comprising an elastomeric member of an annular configuration, an annular array of uniformly spaced antenna ribs rigidly affixed at the base ends thereof to said actuator and supported thereby for pivotal displacement from a deployed configuration, wherein the ribs are substantially radially extended from said actuator to a furled configuration wherein the ribs are extended in substantial parallelism with the axis of the actuator, a flexible reflecting web affixed to the ribs, and a plurality of angularly spaced bearing blocks supporting every radially extended section of the member for rotation about its own centroid.

6 Claims, 7 Drawing Figures

FURLABLE ANTENNA

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Field of the Invention:

The invention generally relates to antennas and more particularly to an improved furlable antenna having an improved actuator for effecting selective deployment of the antenna reflector.

Future spacecraft missions to the outer planets of our solar system will require communication systems capable of transmitting data at significantly expanded data rates. Expanded data rates, in turn, require a use of antennas having reflectors of increased dimensions. Because of weight and bulk limitations imposed by the designers of space vehicles, antenna reflectors having an operating diameter larger than the dimensions of spaces provided for stowage, must be so constructed as to accommodate furling in order to facilitate stowage, and unfurling in order to achieve deployment.

2. Description of the Prior Art:

As is fully appreciated by those engaged in the design and fabrication of communication systems for use aboard operating spacecraft, numerous designs for antenna reflectors capable of being furled and unfurled have been proposed. In most instances it has been assumed by the designer of the furlable reflector that some suitable actuator for unfurling or deploying the reflector will be made available by others. Yet, as should be apparent, a satisfactory actuator should be of light weight and reliable construction, simple to operate and economic to fabricate. As a consequence of this combination of requirements, there exists a dearth of suitable antennas having capabilities necessary for assuring completion of successful missions.

It is, therefore, the general purpose of the instant invention to provide for use in a communication system, particularly adapted for use in celestial space, an improved antenna having a reflector of increased dimensions, for accommodating expansion of data rates and equipped with a simple, economic, lightweight and reliable actuator and having a capability for being launched aboard existing spacecraft in a furled configuration and subsequently expanded into an unfurled deployed configuration.

OBJECTS AND SUMMARY OF THE INVENTION

It is, therefore, an object of the instant invention to provide an improved antenna which overcomes the aforementioned difficulties and disadvantages.

It is another object to provide an antenna particularly suited for use in a celestial space environment having an improved reflector characterized by increased dimensions for accommodating expanded data rates.

Another object is to provide a furlable antenna having an improved actuator capable of storing energy, as the antenna is furled, for subsequent release to effect an automatic unfurling of the antenna into a deployed configuration.

Another object is to provide an improved antenna characterized by a furlable reflector connected for deployment with an improved actuator conforming substantially to an annular member, each radial section thereof being supported for rotation in its plane about its centroid.

Another object is to provide in a furlable antenna an improved actuator which is particularly useful in deploying the antenna in celestial space, although not necessarily restricted in use thereto since the actuator may be similarly useful when installed in devices such as clutches and the like, as will more readily become apparent by reference to the following description and claims in light of the accompanying drawings.

These and other objects and advantages are achieved by coupling with a furlable antenna of the type having an annular array of uniformly spaced antenna ribs and a flexible reflecting web, a deployment actuator including an annular member formed of elastomeric materials, characterized by a selected elastic modulus, and supported in a manner such that every radially extended section of the member is supported for rotation in its own plane, about its own centroid, whereby as the array is displaced to its furled configuration energy is stored in the annular member, preparatory to its being released for deploying the antenna.

DESCRIPTION OF THE PREFERRED EMBODIMENT

Figure 1:
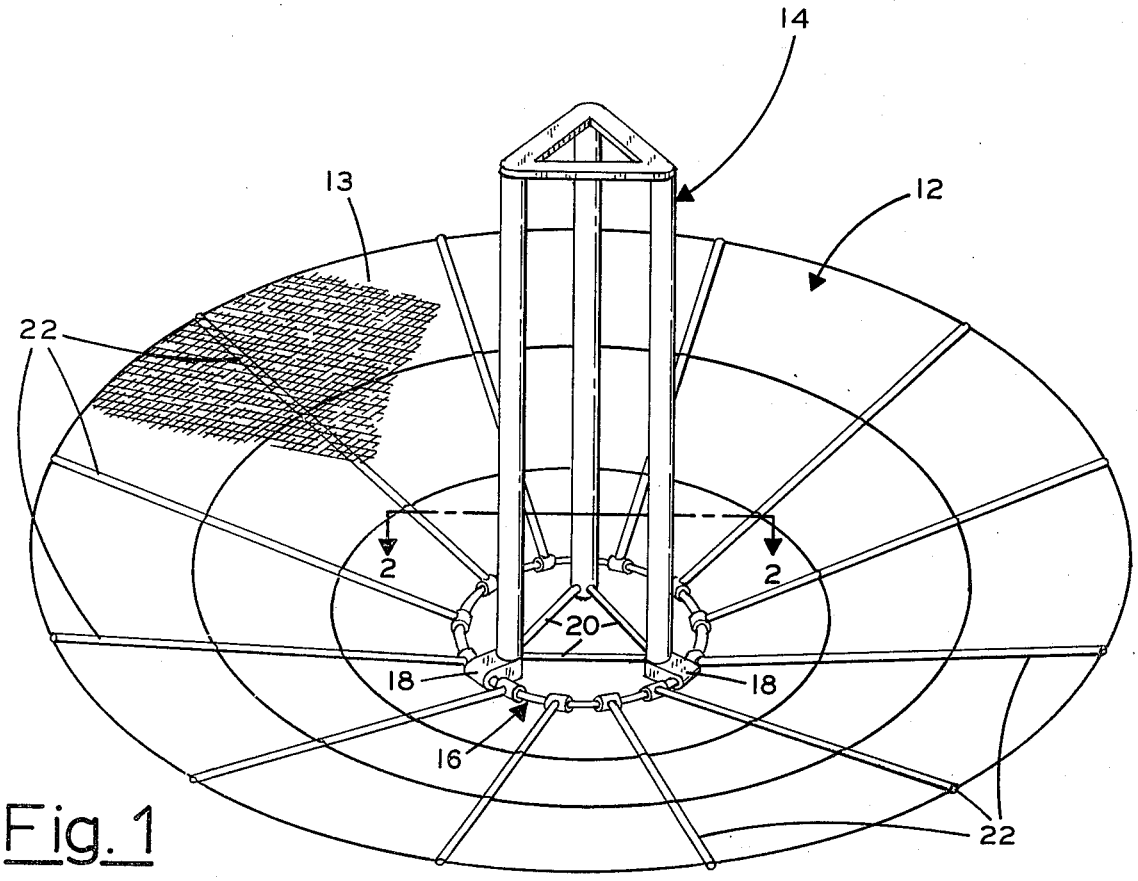
FIG. 1 is a perspective view of a furlable antenna having provided therefor a deployment actuator of an annular configuration supporting a plurality of ribs upon which is mounted a reflector of flexible material.

Referring now to the drawings, with more particularity, wherein like reference characters designate like or corresponding parts throughout the several views, there is shown in FIG. 1 an improved antenna which embodies the principles of the instant invention.

As shown in the drawings, the antenna includes a furlable reflector, generally designated 12, of a dish-shaped configuration and formed of a flexible reflector material 13. The specific configuration of the reflector forms no specific part of the invention and may be varied as desired. An elongaged structural support, designated 14, is coaxially aligned with said reflector and is provided for supporting an electronic receiver-transmitter package along the axis of the antenna, in a manner fully appreciated by those familiar with the principles of antenna design. The structural support 14, further, serves as a base upon which is mounted an actuator 16, the purpose of which will hereinafter become apparent. The material 13 preferably is a flexible mesh material, which also forms no specific part of the instant invention, however, it is to be understood that where so desired, the material 13 comprises a metallic mesh.

To the structural support 14 there is affixed a plurality of angularly spaced bearing blocks 18 interconnected through suitable links 20. The links are united in an end-to-end relationship to form a triangular truss for supporting the bearing blocks in a fixed relationship. The links 20 are connected with the bearing blocks 18 in any suitable manner, such as by welding and the like. Each of the bearing blocks 18, in turn, includes a bore formed therein within which there is inserted a suitable plain bearing sleeve, not shown, which serves to receive a segment of the actuator 16.

Figure 6:
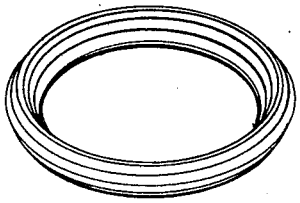
FIG. 6 is a perspective view of the actuator illustrating laminar construction.

The actuator 16 comprises an annular member formed of elastomeric material having a suitable elastic modulus. Where so desired, the actuator 16 is fabricated from annular layers of fiberglass, FIG. 6, disposed in superimposed relation and supported in an epoxy matrix, and is of prestressed construction, where so desired, in order to establish predetermined torque characteristics therefor.

Attached to the actuator 16 in uniformly spaced relation, there is an annular array of ribs 22 which serve to support the flexible material 13. The material is united with the ribs 22 in a suitable fashion, such as through a use of epoxy.

Figure 4:
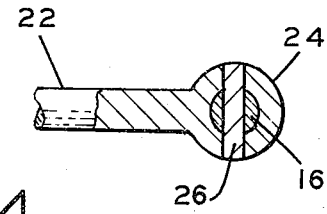
FIGS. 4 and 5 are fragmented, partially sectioned views illustrating alternative structure adapted to be employed in connecting the ribs with the actuator.
Figure 3:
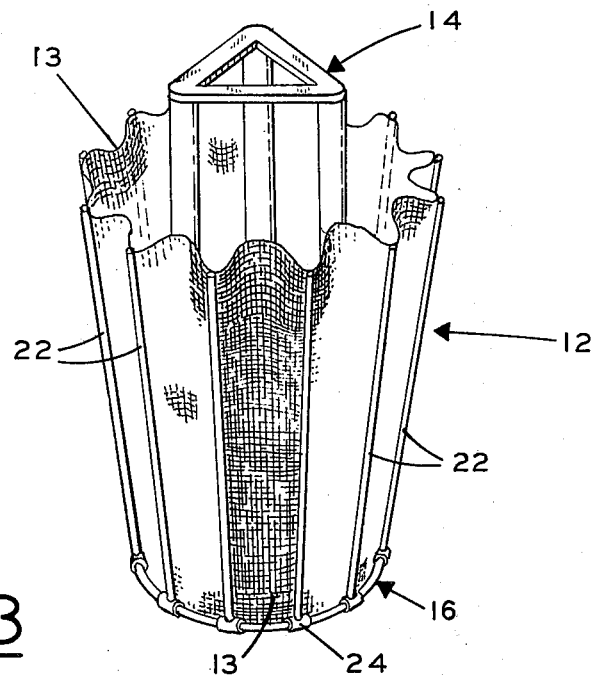
FIG. 3 is a perspective view illustrating the antenna in a furled configuration.
Figure 5:
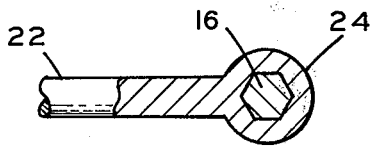

The base end of each of the ribs 22 is provided with an eye 24 through which the actuator 16 is extended. The eye is attached to the actuator in any suitable manner including, where so desired, a use of pins 26, FIG. 4, extended through the actuator 16 or, where so desired, the eyes can be characterized by noncircular cross-sectional configurations, as best illustrated in FIG. 5. In any event, it is to be understood that the ribs 22 are rigidly affixed at their base ends to the annular actuator 16 in a manner such that when the antenna is deployed the ribs 22 extend substantially radially from the annular actuator 16, in uniformly diverging patterns, as illustrated in FIG. 1. Similarly, when the reflector 12 is in its furled configuration, as illustrated in FIG. 3, the ribs 22 extend in substantial parallelism. Thus, the ribs 22 are affixed at their base ends to the annular actuator 16 and form an annular array of uniformly spaced antenna ribs which serve to support the reflector 12 in its furled as well as its deployed or unfurled configuration.

OPERATION

It is believed that in view of the foregoing description, the operation of the device will readily be understood and it will be briefly reviewed at this point.

With the antenna assembled in the manner hereinbefore described, it is to be understood that when the annular array of uniformly spaced antenna ribs are in a substantially radially extended relationship with the annular actuator 16, the flexible material 13 is drawn taut and configured in a slightly conical or parabolic configuration suitable for use as an antenna reflector in a communication link. Alternatively, when the annular array of uniformly spaced antenna ribs 22 are arranged in substantial parallelism, as illustrated in FIG. 3, the reflector 12 is in its furled configuration, particularly suited to be received by shrouds of a launch vehicle.

Figure 7:
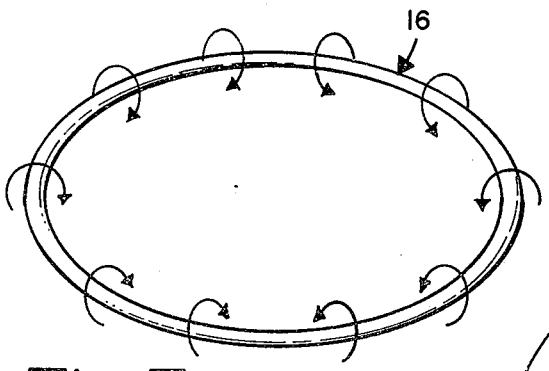
FIG. 7 is a diagrammatic view illustrating operation of the actuator.
Figure 2:
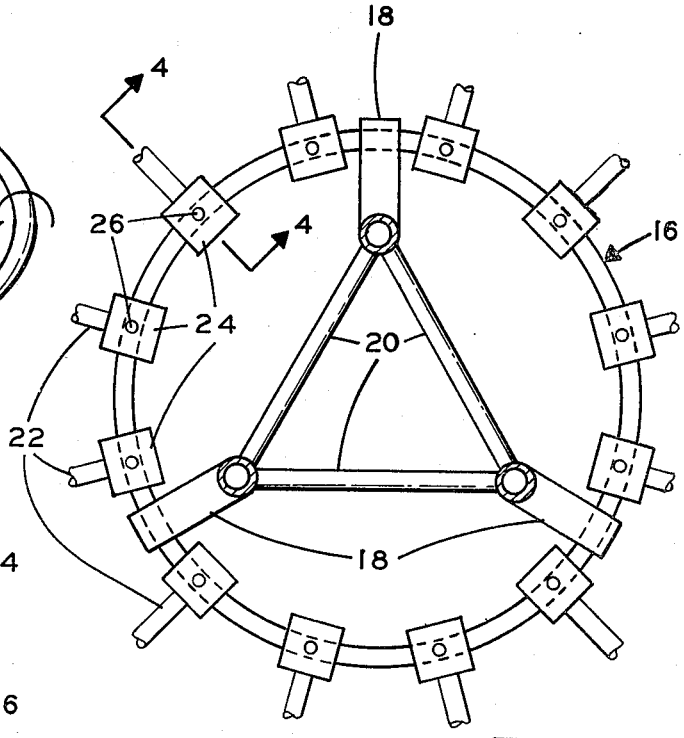
FIG. 2 is a fragmented top plan view of the antenna, taken generally along line 2—2 of FIG. 1.

In order to impart to the antenna a furled configuration, the ribs 22 are simultaneously pivoted into mutual parallelism, as illustrated in FIG. 3. As illustrated in FIG. 7, the pivoting of the ribs tends to cause the annular actuator 16 to rotate, each section about its own centroid. Such rotation is accommodated by the bearing blocks 18 and since the ribs 22 are affixed to the annular actuator 16, forcing the ribs into mutual parallelism tends to roll the annular actuator inwardly, in effect, tending to turn the actuator outside in. This causes the actuator to undergo bending. It is important here to appreciate that energy is thus stored in the actuator, even though the actuator is permitted to turn outside in, as illustrated in FIG. 7.

Once a space vehicle, having the antenna stowed aboard in a furled configuration, is launched, and a shroud confining the furled antenna is ejected, the antenna is released from confining restraint, whereupon the ribs 22 are pivoted outwardly into their substantial radial relationship by the actuator 16 for thus tightening the flexible material 13 in its deployed configuration. Thus the actuator 16 functions to deploy or unfurl the reflector 12 in response to a release of energy stored therein as the antenna is reduced to its furled configuration.

In view of the foregoing, it should readily be apparent that the antenna of the instant invention provides a practical solution to the perplexing problem of reliably achieving deployment of relatively large dish-shaped antenna reflectors adapted to be put into a celestial space environment employing space vehicles having limited stowage capacities.

Although the invention has been herein shown and described in what is conceived to be the most practical and preferred embodiment, it is recognized that departures may be made therefrom within the scope of the invention, which is not to be limited to the illustrative details disclosed.

What is claimed is:

1. A furlable antenna comprising:

A. a deployment actuator including an annular member characterized by a selected elastic modulus;

B. an annular array of uniformly spaced antenna ribs rigidly affixed at one end thereof to said annular member and supported by said member for pivotal displacement from a deployed configuration, wherein the ribs are extended substantially radially from said annular member, to a furled configuration wherein said ribs are extended in substantial parallelism;

C. a flexible reflecting web extended between said ribs and affixed thereto; and D. a plurality of bearing blocks rotatably supporting said annular member in a manner such that every radially extended section of the member is supported for rotation in its own plane, about its own centroid, as said array is displaced.

2. The antenna of claim 1 wherein said one end of each of said ribs includes an eye and said member is extended therethrough.

3. The antenna of claim 2 wherein said member includes a plurality of uniformly spaced segments of a noncircular cross-sectional configuration concentrically related to the eye of each of the ribs of said array.

4. The antenna of claim 2 further including a plurality of uniformly spaced pins extended through said annular member for connecting said ribs with said annular member.

5. The antenna of claim 2 wherein said member includes a plurality of annular layers of fiberglass held in an epoxy matrix.

6. In a furlable antenna, an improved actuator including:

A. an annular member having a selected elastic modulus comprising a plurality of annular layers of fiberglass held in an epoxy matrix; and B. means supporting said member including a plurality of uniformly spaced bearing blocks supporting said annular member in a manner such that every radially extended section of the member is supported for rotation in its own plane, about its own centroid.

* * * * *